US010675631B2

(12) United States Patent
Enderle et al.

(10) Patent No.: US 10,675,631 B2
(45) Date of Patent: Jun. 9, 2020

(54) SEPARATING DEVICE FOR A BALL MILL OR AGITATOR BALL MILL AS WELL AS A BALL MILL OR AGITATOR BALL MILL WITH A SEPARATING DEVICE

(71) Applicant: NETZSCH-Feinmahltechnik GmbH, Selb (DE)

(72) Inventors: Udo Enderle, Arzberg (DE); Thomas Goller, Schwarzenbach/Saale (DE); Benjamin Graef, Zell im Fichtelgebirge (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 1136 days.

(21) Appl. No.: 15/013,328

(22) Filed: Feb. 2, 2016

(65) Prior Publication Data

US 2016/0144372 A1 May 26, 2016

Related U.S. Application Data

(63) Continuation of application No. PCT/DE2014/000406, filed on Aug. 7, 2014.

(30) Foreign Application Priority Data

Aug. 14, 2013 (DE) ..... 10 2013 108 809

(51) Int. Cl.
*B02C 17/16* (2006.01)

(52) U.S. Cl.
CPC ..... *B02C 17/161* (2013.01)

(58) Field of Classification Search
CPC ..... B02C 17/02; B02C 17/16; B02C 17/161; B02C 17/18; B02C 17/1835;
(Continued)

(56) References Cited

U.S. PATENT DOCUMENTS 1,082,960 A * 12/1913 Lane ..... B02C 13/284 241/74
3,814,334 A * 6/1974 Funk ..... B02C 17/161 241/70

(Continued)

FOREIGN PATENT DOCUMENTS

DE 153331 A1 1/1982
DE 3313477 A1 10/1984

(Continued)

OTHER PUBLICATIONS

International Search Report Application No. PCT/DE2014/000406 Completed: Nov. 11, 2014; dated Nov. 21, 2014 3 pages.

*Primary Examiner* — Teresa M Ekiert
*Assistant Examiner* — Jared O Brown
(74) *Attorney, Agent, or Firm* — Whitmyer IP Group LLC

(57) ABSTRACT

A separating device for a ball mill or an agitator ball mill as well as a ball mill or agitator ball mill with a separating device, wherein the ball mill or agitator ball mill includes a cylindrical grinding container with a first end opening and a second end opening, wherein the first and second end openings can be closed by a first and a second closure device, wherein a ground stock inlet is arranged in the region of the second end opening and a ground stock outlet is arranged in the region of the first end opening and wherein the separating device is assigned to the ground stock outlet. The separating device includes a plurality of first and second screen segments with screen apertures, which are arranged in an alternating manner on a frame.

14 Claims, 8 Drawing Sheets

(58) Field of Classification Search
CPC ..... B02C 17/1855; B02C 23/08; B02C 23/10; B02C 23/14; B02C 23/16; B02C 23/165
USPC ..... 241/73, 74
See application file for complete search history.

(56) References Cited

U.S. PATENT DOCUMENTS

| | | | | |
|---|---|---|---|---|
| 4,394,981 | A * | 7/1983 | Schold | B02C 17/161 241/46.17 |
| 2004/0056128 | A1* | 3/2004 | Uebayashi | B02C 13/14 241/74 |

FOREIGN PATENT DOCUMENTS

| | | | |
|---|---|---|---|
| DE | 3726610 | A1 | 7/1988 |
| DE | 4412408 | A1 | 10/1995 |
| DE | 19830960 | A1 | 1/2000 |
| DE | 102007012526 | A1 | 9/2008 |
| DE | 102010053484 | A1 | 6/2012 |
| EP | 0079667 | A2 | 5/1983 |
| WO | 2004101154 | A2 | 11/2004 |

* cited by examiner

B-B

C-C

D-D

Fig. 6D
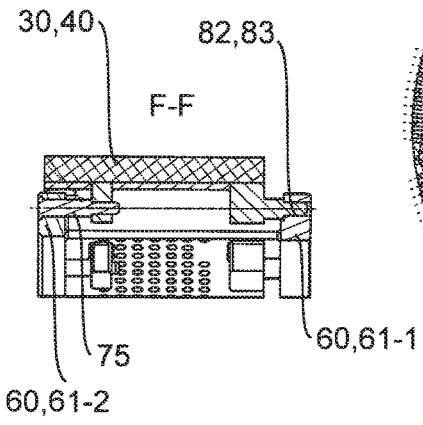
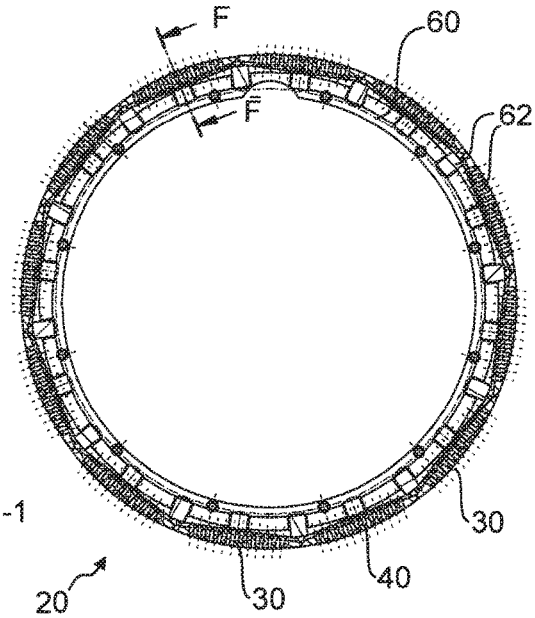
Fig. 6A
Fig. 6C
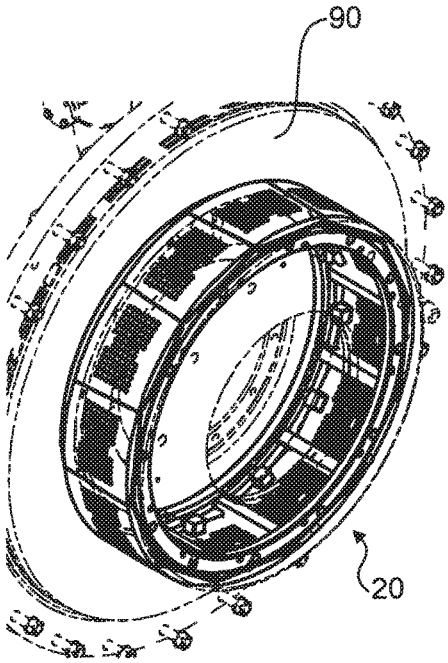
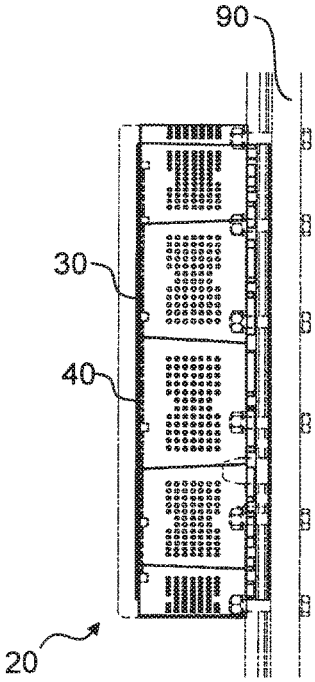
Fig. 6B

SEPARATING DEVICE FOR A BALL MILL OR AGITATOR BALL MILL AS WELL AS A BALL MILL OR AGITATOR BALL MILL WITH A SEPARATING DEVICE

FIELD OF THE INVENTION

The present invention relates to a separating device for a ball mill or agitator ball mill as well as a ball mill or agitator ball mill with a separating device.

BACKGROUND OF THE INVENTION

The invention relates to a separating device for large, preferably horizontally orientated ball mills or agitator ball mills. The ball mill is a device for the coarse, fine and extremely fine size-reduction or homogenisation of grinding stock. It comprises a grinding chamber which is caused to rotate and in which grinding stock is size-reduced by grinding bodies. Ball mills usually comprise an approximately circular-cylindrical grinding container mounted horizontally rotating. The mills are filled through a central opening at an end wall. The output is dependent on the design and takes place for example via slots in the grinding chamber wall at the end of the mill, wherein the grinding bodies are held back by a separating device.

A special form of the ball mill is the agitator ball mill. Agitator ball mills comprise a vertically or horizontally disposed, usually approximately cylindrical grinding container, which is filled 70-90% with grinding bodies. The grinding chamber is usually stationary, non-rotating in the case of agitator ball mills. An agitator with suitable agitator elements provides for the intensive motion of the grinding bodies. The grinding stock suspension is continuously pumped through the grinding chamber. The suspended solids are size-reduced or dispersed by impact or shearing forces between the grinding bodies. The separation of grinding stock and grinding bodies takes place by means of a suitable separating device at the exit from the mill.

Such a separating device for holding back the grinding bodies usually comprises a sieve, which only allows the passage of the ground product. The sieve can be constituted either rotating with the shaft or can be disposed statically and is disposed in the grinding container in the outlet region for the treated product.

For example, dynamic separating devices for agitator ball mills are known, which are constituted such that a gap is created between a stator fastened to the fastened part of the agitator ball mill and a rotor connected to the rotating part of the agitator ball mill, through which gap only the ground stock can pass. The problem with such separating devices is that the grinding balls separated from the stock or contained in it collect in the edge region of the rotor and are moved together with the rotor, as a result of which rapid wear of the stator and rotor is caused.

DE 4412408 A1 describes an agitator ball mill with grinding bodies. A standard separating device is disposed upstream of the grinding stock outlet. Upstream of said separating device is a pre-grading disc, which preferably conveys the grinding bodies entering into its sphere of action radially outwards. The pre-grading disc is a component of a rotating cage for the most part surrounding the outlet body. As a result of the rotation of the cage, a radial inflow of grinding stock and grinding bodies to the outlet body is for the most part prevented. The separating device is thus largely removed from the impact of the grinding bodies, as a result of which the wear on the separating device can be reduced. Furthermore, the throughput of the agitator mill can be increased considerably.

DD 153331 A1 describes an agitator ball mill for the continuous size-reduction and dispersion of liquid-solid mixtures, which is provided with a separating device. A grinding body build-up in front of the separating sieve is avoided with the agitator ball mill and the entire sieve and area is covered by the grinding body/grinding stock movement. Furthermore, a replacement of the separating sieve can be made without emptying the grinding container. The separating device comprises a flat sieve and is disposed horizontally parallel to the agitator shaft axis at the highest point, at the end of the grinding chamber in the lid of the grinding container constituted as a sieve housing. The separating device is covered by a grinding stock collecting hood equipped with an outlet connecting piece directed obliquely upwards.

DE 19830960 A1 describes a separating device for an agitator ball mill with a sieve, wherein the sieve comprises varying sieve gaps. In particular, the separating device can be present in a first operating position, in which the elements limiting the sieve gap are held at a first spacing by at least partially non-elastic spacers. In a cleaning position, the elements assume a second spacing, which is larger than the first spacing, so that blockages can easily be removed from the sieve gap.

DE 102007012526 A1 shows a further separating device for grinding bodies of agitator ball mills. DE 102010053484 A1 shows an agitator ball mill with a separating device comprising at least two components. A first component is the separating device and a second component is a dynamic element for generating a material flow.

An object of the present invention is to provide a separating device for a ball mill, in particular for an agitator ball mill, said separating device being able to be installed in a straightforward manner and, if need be, capable of being repaired quickly or replaced in part or completely.

The above problems are solved by a separating device for a ball mill or agitator ball mill as well as a ball mill or agitator ball mill with a separating device according to the invention.

SUMMARY OF THE INVENTION

The invention relates to a separating device for a ball mill or an agitator ball mill. In the following, the term mill is used both for ball mills with a rotating grinding container as well as for agitator ball mills with agitator tools. In the case of agitator ball mills, the grinding container can be mounted rotating as well as non-rotating. The grinding container of mills comprises a first and a second end-face opening. In particular, the grinding container is a hollow cylinder to be opened at least at one side, said hollow cylinder being disposed horizontal and comprising a preferably circular opening at one of the free ends. Other geometries of the grinding container, for example containers with a largely symmetrically polygonal, in particular an octagonal cross-section or suchlike, are also conceivable and are intended to be covered by the invention. The second opening is closed by a second closure device, in particular by a lid. In the case of agitator ball mills, the agitator is usually assigned to the second closure device of the second opening.

Located in the region of the first end-face opening are a grinding stock outlet and a separating device for separating the grinding bodies from the ground product. The first end-face opening is closed by a first closure device. The separating device is usually assigned to the first closure device or is disposed in the region of the grinding stock outlet and/or assigned to the latter.

According to the invention, the separating device comprises a plurality of first and second sieve segments with sieve openings. The first and second sieve segments are disposed alternately on a frame. The arrangement of the first and second sieve segments on the frame constitutes a cylindrical shape of the separating device. For this purpose, the sieve segments each comprise at least one convexly curved outer lateral surface. The sieve segments are disposed on the frame in such a way that the convexly curved outer lateral surfaces of all the sieve segments together form a cylindrical outer lateral shape of the separating device. The outer cylinder of the separating device preferably has a circular base area. A particular advantage of the present invention consists in the fact that the sieve openings can be introduced mechanically into the respective sieve segments. The sieve openings always had to be introduced (produced) manually in the separating devices for large mills that were known from the prior art, since a suitable automation was not possible or not expedient.

According to a preferred embodiment of the invention, the sieve segments each have trapezoidal areas, in particular each have isosceles trapezoidal areas. The coating is preferably deposited on the trapezoidal areas. The coating preferably has a maximum thickness in the region of an axis of symmetry of the isosceles trapezoidal area and a minimum thickness in the region of the sides of the isosceles trapezoidal area. In particular, the coating forms the convex outwardly curved outer lateral surface of the sieve segments with the maximum thickness in the region of an axis of symmetry of the isosceles trapezoidal area. After assembly of the sieve segments on the frame, the coating side of the trapezoidal areas of the sieve segments forms the outer lateral surface of the separating device cylinder.

According to an embodiment of the invention, the trapezoidal areas are constituted as sieve plates with first pass-through openings for the grinding stock. The coating comprises second pass-through openings for the grinding stock, which are disposed in alignment with the first pass-through openings of the trapezoidal areas. The size of the pass-through openings or sieve openings is selected such that the grinding bodies are held back, whereas the ground grinding stock can be removed via the grinding stock outlet from the ball mill or agitator ball mill.

The frame on which these sieve segments are disposed comprises two annular elements which are connected together by transverse elements. The transverse elements are disposed at regular intervals, in particular the spacing between two directly adjacent transverse elements is always constituted identical.

The first and second sieve segments preferably comprise trapezoidal areas with identical areas. The spacing between the transverse elements of the frame largely corresponds to the mean value of the lengths of the base sides of the trapezoidal areas. The width of the transverse elements is preferably selected such that the trapezoidal sides of a first or second sieve segment disposed between two transverse elements lie for the most part completely on the transverse elements. According to an embodiment of the invention, the region of the coating extending beyond the trapezoidal sides lies on the transverse elements, whereas the trapezoidal areas are disposed between the transverse elements.

The first and second sieve segments essentially differ in the arrangement of connecting means and locating means, which are used for the fastening to the frame. The connecting means and locating means are disposed in particular on the non-coated side of the trapezoidal area. In particular, a connecting means is assigned centrally to the short base side of the first sieve segments and a locating means is also assigned centrally in the region of or adjacent to the long base side of the first sieve segments. The position "centrally" relates in particular to a position along the axis of symmetry of the isosceles trapezoidal area. In contrast, the locating means is assigned centrally in the region of or adjacent to the short base side of the second sieve segments and a connecting means is assigned centrally to the long base side of the second sieve segments. The first and second sieve segments are preferably constituted such that their respective basic shape is constituted mirror-symmetrical to one another, wherein the arrangement of the locating and connecting means is specific for each of the sieve segments. As a result of this embodiment, it is possible to produce the sieve segments from identical basic segments and only to change the arrangement of the locating and connecting means, in particular on the respective sides without a coating, which after assembly of the sieve segments bound the internal space of the separating device cylinder.

Furthermore, fastening sockets for the connecting means of the first and second sieve segments are assigned to the first annular element and fastening devices for fastening the first and second sieve segments are assigned to the second annular element of the frame. The first and second sieve segments are disposed on and fastened to the second annular element by means of the fastening devices and connecting means engaging through the locating means of the sieve segments.

During the assembly of a separating device according to the invention, the sieve segments are fastened to the frame, for example a steel base body (a so-called displacement body) forming the sieve plate. Fitted on the sieve plate of the sieve segments on the one base side is a bolt, a socket being constituted on the other side. As described above, the different sieve segments differ in the arrangement of the bolt and socket. The bolt is inserted into the displacement body directly on the rear side; on the front side, a separate bolt is pushed from the front through the steel base body or displacement body into the socket of the sieve plate of the sieve segment. Furthermore, the rubber coating of the sieve segments is constituted conical in the axial direction, in order that the sieve segments can be pressed against one another and a compression and thus sealing at the sides forming the abutting edges results.

According to a preferred embodiment, the short base side is constituted as the bolt side and the long base side as the socket side in the case of the first sieve segments. In the case of the second sieve segments, on the other hand, the short base side is constituted as the socket side and the long base side as the bolt side. During assembly of the separating device, all the second sieve segments with the bolts on the long base side are inserted into the steel base body or displacement body, wherein space for a first sieve segment is left free in each case between the individual second sieve segments. The first sieve segments inserted last can be pushed manually between the adjacent second sieve segments until the conical rubber surfaces or the trapezoidal sides lie adjacent to one another. The rubber surfaces of the trapezoidal sides lying adjacent to one another lie in particular in a form-fit and/or friction-locked manner against one another. The axial displacement then still required is achieved by the closing of the lid, i.e. the first closure device closing the first end-face opening of the grinding container, so that all the sieve segments lie flush against one another in the axial direction. The lid or the first closure device is screwed to the steel base body or displacement body and lies above the separately inserted bolt. It thus prevents loosening of the sieve segments.

The number of sieve segments comprising a separating device varies depending on the size of the machine. The convexity of the one outer lateral surface of the sieve segments, in particular the convexity of the coating, must also be adapted to the number of the sieve segments and the size of the machine.

The modular structure of the separating device according to the invention permits easy assembly of the separating device particularly in the case of large ball mills or agitator ball mills. On account of the modular structure, it is possible to replace in a targeted manner only areas that are damaged or where there is wear on individual sieve segments. The individual components, in particular the individual sieve plates, are relatively small and therefore, precisely in the case of mills with a large diameter, are easier to handle than the separating systems known from the prior art.

The separating device according to the invention can easily be assembled subsequently on a first closure device or lid of an existing mill. Mills with the separating device according to the invention can thus be retrofitted in a straightforward, rapid and cost-effective manner.

The invention also relates to a ball mill or an agitator ball mill with a cylindrical grinding container with a first end-face opening and a second end-face opening, wherein the first and the second end-face opening can be closed by a first and a second closure device, wherein a grinding stock inlet is disposed in the region of the second end-face opening and a grinding stock outlet in the region of the first end-face opening and wherein a separating device is assigned to the grinding stock outlet. According to the invention, the ball mill or the agitator ball mill comprises a separating device with a plurality of first and second sieve segments with sieve openings, in particular a separating device with the features described above.

BRIEF DESCRIPTION OF THE DRAWINGS

Examples of embodiment of the invention and its advantages are explained below in greater detail with the aid of the appended figures. The size ratios of the individual elements with respect to one another in the figures do not always correspond to the actual size ratios, since some forms are represented simplified and other forms are represented enlarged in relation to the other elements for the sake of better illustration.

FIGS. 6A-6D show different views of the assembled separating device according to the invention fastened to a lid for the closure of the grinding container.

DETAILED DESCRIPTION OF THE INVENTION

Identical reference numbers are used for identical or identically acting elements of the invention. Furthermore, for the sake of a clearer view, only reference numbers are represented in the individual figures that are required for the description of the respective figure. The represented embodiments only represent examples as to how the device according to the invention can be constituted and do not represent a conclusive limitation.

Figure 1:
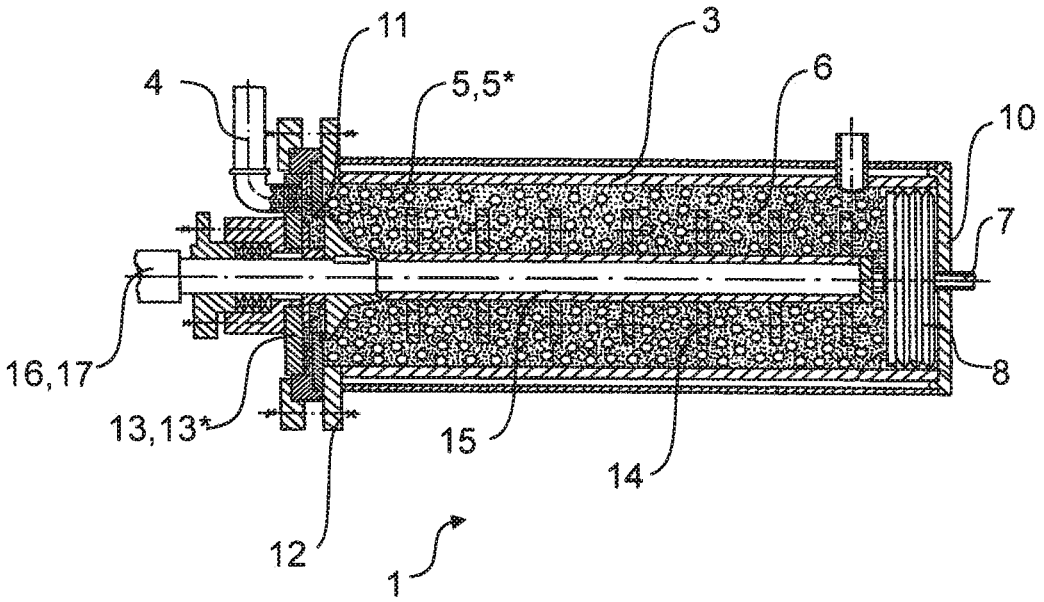
Fig. 1 (Prior Art)
FIG. 1 shows a diagrammatic longitudinal cross-section through an agitator ball mill.

FIG. 1 shows a diagrammatic longitudinal cross-section through an agitator ball mill 1 according to the prior art. The latter comprises a horizontally mounted grinding container 3, Furthermore, it can be seen that an outlet 7 for removing the grinding stock with separating system 8 is assigned to the one first end wall 10. The other second end wall 11 of grinding container 3 is constituted open and comprises a grinding container flange 12. Open end wall 11 of grinding container 3 is closed with a lid 13 with lid flange 13*. Sealing elements are disposed on lid 13 on the container side for the purpose of a sealed fastening. Grinding stock inlet 4 is also assigned to lid 13, via which grinding stock 5 is introduced into grinding container 3, Grinding container 3 is filled with grinding balls 6 and also comprises agitator elements 14, which ensure the intensive motion of grinding balls 6, while for example a grinding stock suspension 5* is continuously pumped through the grinding chamber of grinding container 3. Agitator elements 14 are disposed for example on a common drive shaft 15, which is driven by a suitable drive means 16. Drive means 16 is for example an electric motor 17 and is disposed on the outer side of lid 13.

Figure 2:
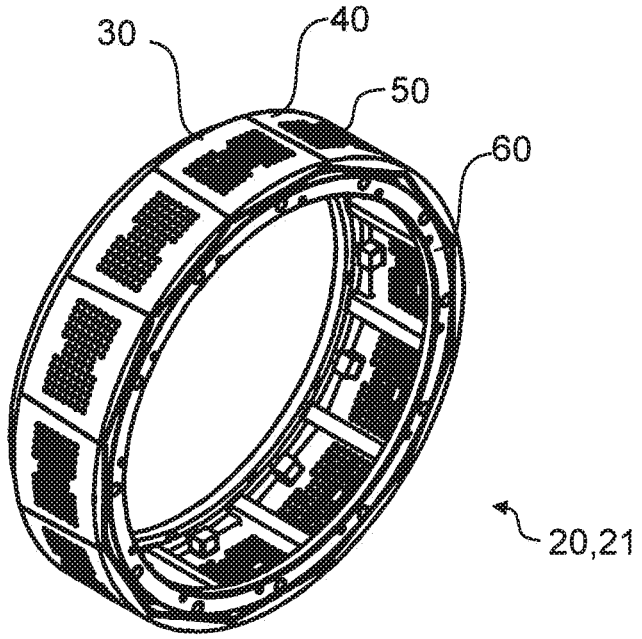
FIG. 2 shows a separating device according to the invention for a mill, in particular for a large agitator ball mill.

FIG. 2 shows a separating device 20 according to the invention for a mill, in particular for a large agitator ball mill 1 (see FIG. 1). Separating device 20 is designed as a kind of sieve cylinder 21, wherein the size of sieve openings 50 is selected such that auxiliary grinding means 6 (see FIG. 1) are held back, while ground grinding stock 5, 5* can be removed from the mill or agitator ball mill 1 via grinding stock outlet 7 (see FIG. 1). Sieve cylinder 21 comprises a plurality of individual sieve segments 30, 40, the number whereof varies according to the size of the machine. Sieve segments 30, 40 can be arranged in a row in the form of a circle and disposed on a frame 60, so that together they form separating device 20 in the form of a cylinder with a circular base area.

FIG. 3 show different views and details of frame 60 of separating device 20 according to the invention. In particular, FIG. 3A shows a perspective view and FIG. 3B a side view. Frame 60 comprises two annular frame elements 61-1 and 61-2, which are connected together by transverse elements 62. Transverse elements 62 each project at least in sections above the outer diameter of annular frame elements 61-1 and 61-2 and each form in this region projecting support faces 63. First annular frame element 61-1 comprises a fastening socket 70 for connecting elements of sieve segments 30, 40 in each case centrally between two transverse elements 62 and second annular frame element 61-2 comprises a fastening device 72 for connecting means of sieve segments 30, 40 in each case centrally between two transverse elements 62. Fastening sockets 70 and fastening devices 72 are each preferably disposed lying opposite one another. Transverse elements 62 are preferably disposed parallel with one another between the two annular frame elements 61-1 and 61-2.

In the shown example of embodiment, the two annular frame elements 61-1, 61-2 are connected together by twelve uniformly spaced transverse elements 62, i.e. transverse elements 62 are each disposed offset with respect to one another at an angle of $\alpha=30°$ along the circle circumference of annular frame elements 61-1, 61-2 or transverse elements 62 are disposed in each case with a spacing A from one another along the circle circumference of circular frame elements 61-1, 61-2.

Figure 3A:
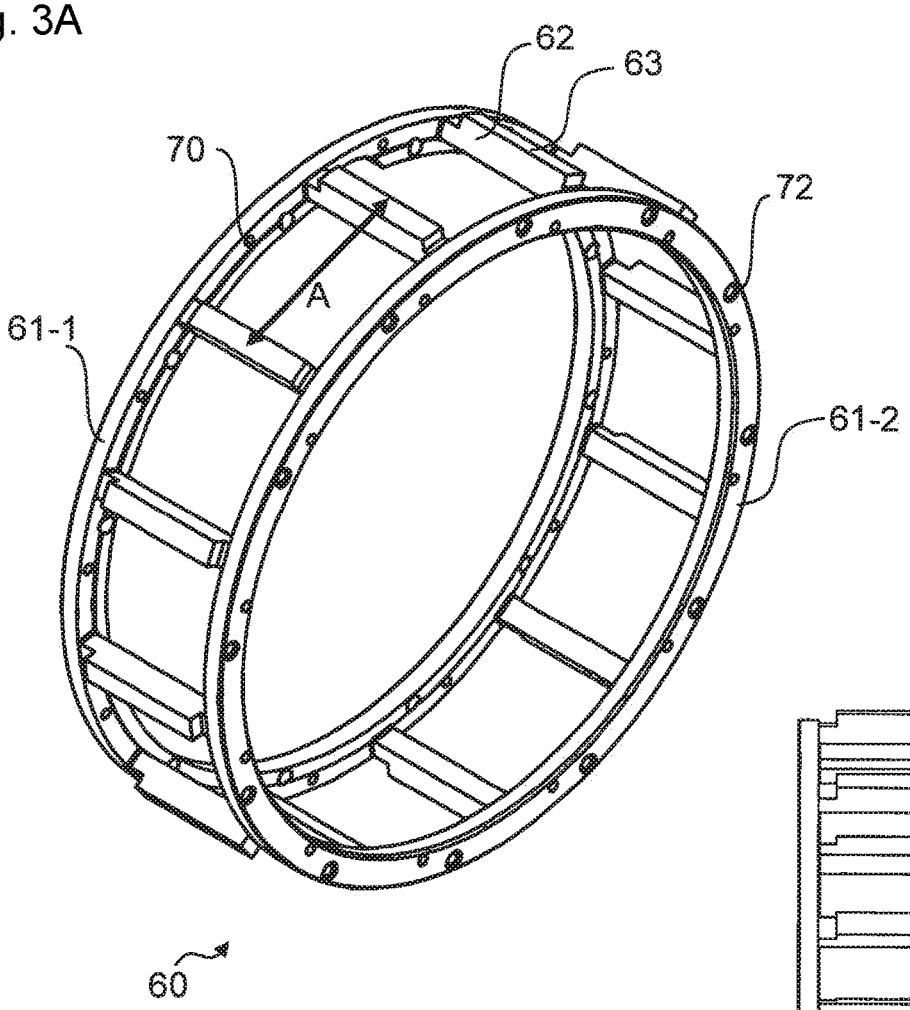
FIGS. 3A-3G show different views and details of the frame of the separating device according to the invention.
Figure 3B:
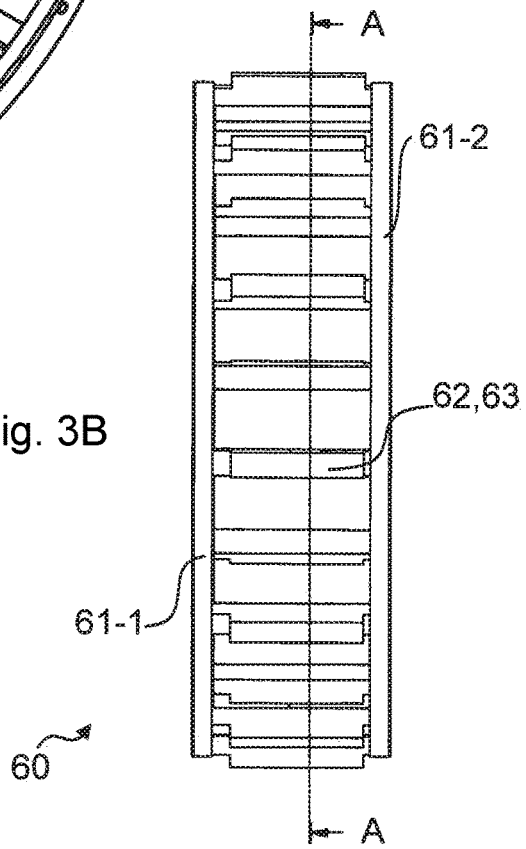
Figure 3C:
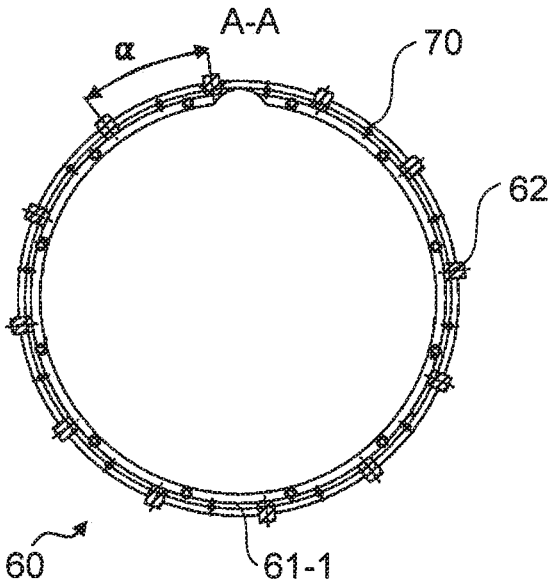
Figure 3D:
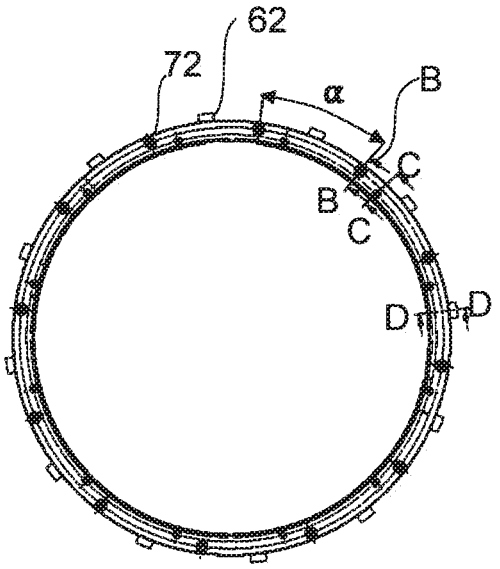
Figure 3E:
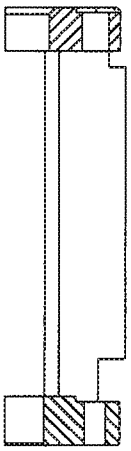
Figure 3F:
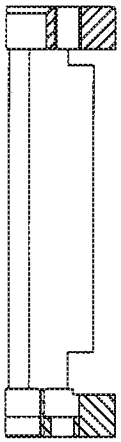
Figure 3G:
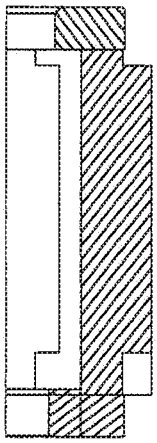

FIG. 3C shows a cross-sectional representation along intersecting line A-A represented in FIG. 3B in a plan view onto a first annular frame element 61-1 with fastening sockets 70, which are each disposed centrally between two adjacent transverse struts 62. FIG. 3D shows a plan view of second annular frame element 61-2 with fastening devices 72, which are each disposed centrally between two adjacent transverse struts 62. FIG. 3E to 3G in each case show a cross-sectional representation along intersecting line B-B, C-C and D-D represented in FIG. 3D.

FIG. 4 show different views of first sieve segments 30 and FIG. 5 show different views of second sieve segments 40. In particular, FIGS. 4A, 5A each show a plan view of a sieve segment 30, 40, FIGS. 4B, 5B each show a side view of a sieve segment 30, 40; FIGS. 4C, 5C each show a cross-sectional representation along intersecting line A-A represented in FIG. 4A or 5A. FIGS. 4D, 4E, 5D, 5E each show different perspective representations of sieve segments 30, 40.

Sieve segments 30, 40 comprise largely plane sieve plates 80 made of metal, in particular steel, or another suitable material. Sieve plates 80 each have the shape of an isosceles trapezoid.

Sieve segments 30, 40 each comprise connecting means 82 and locating means 84. Connecting means 82 are constituted for example by bolts 83, locating means 84 being constituted for example as screw holes 85 or similar receiving points. According to the represented preferred embodiment, first short base side 31 of sieve plate 80-1 is constituted as the bolt side in the case of first sieve segments 30; in particular, connecting means 82 is assigned centrally to short base side 31 of sieve plate 80. Locating means 84 is also disposed centrally adjacent to long base side 32, in particular on mirror axis S between sides 33. Furthermore, long base side 32 of sieve plate 80-2 is constituted as the bolt side in the case of second sieve segments 40; in particular, connecting means 82 is assigned centrally to long base side 32 of sieve plate 80-2. Locating means 84 is also disposed centrally adjacent to short base side 31, in particular on mirror axis S between sides 33.

Figure 4B:
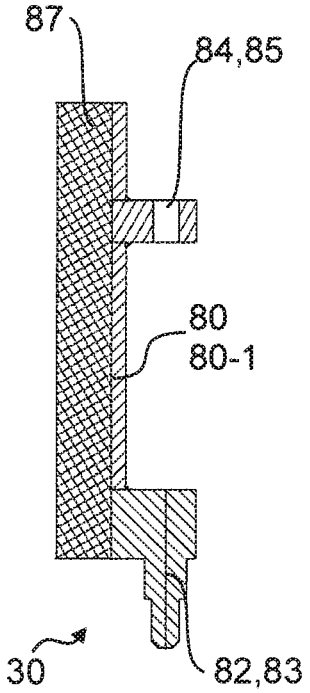
FIGS. 4A-4E show different views of first sieve segments.
Figure 4A:
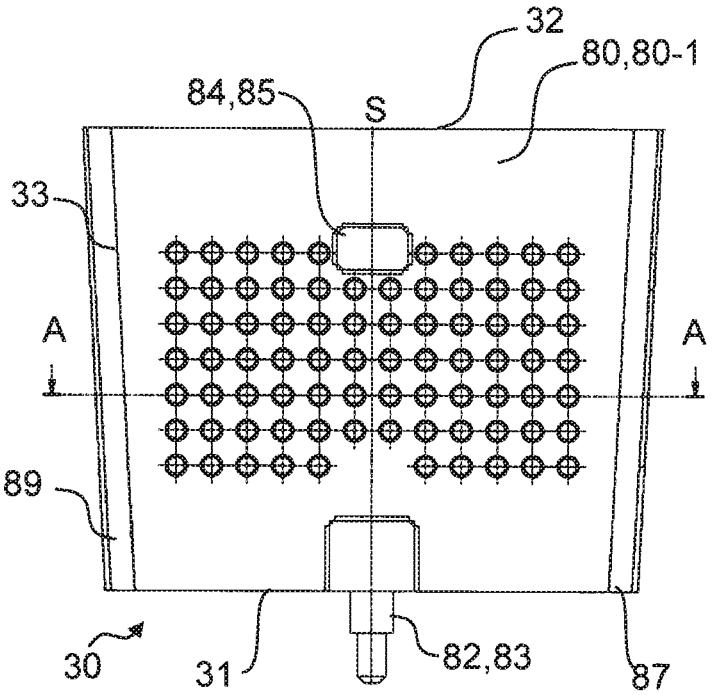
Figure 4C:
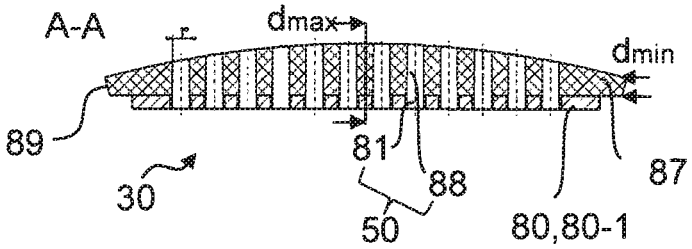
Figure 4D:
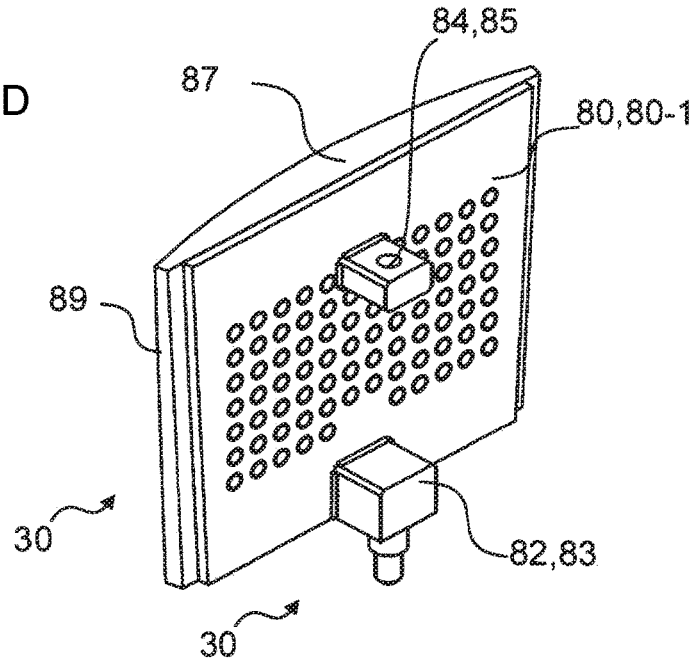
Figure 4E:
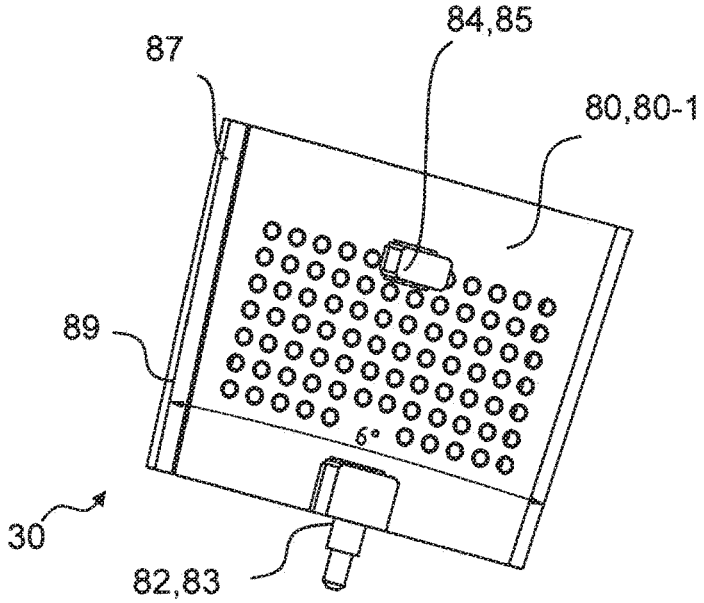
Figure 5B:
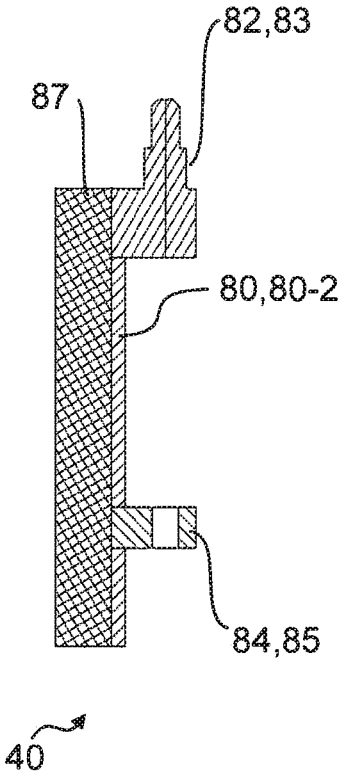
FIGS. 5A-5E show different views of second sieve segments.
Figure 5A:
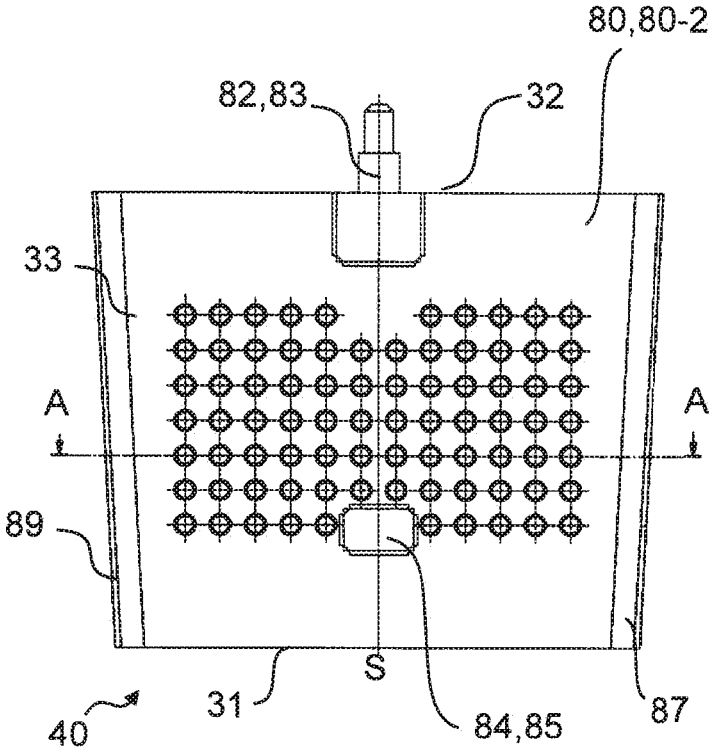
Figure 5C:
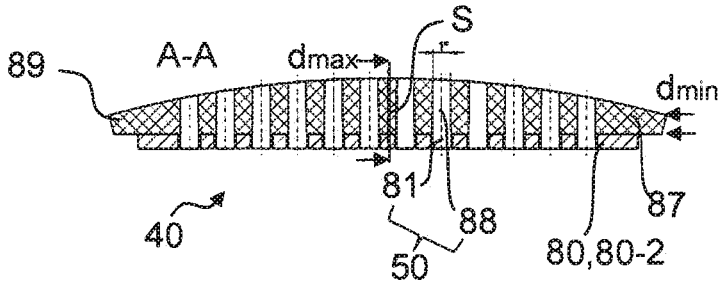
Figure 5D:
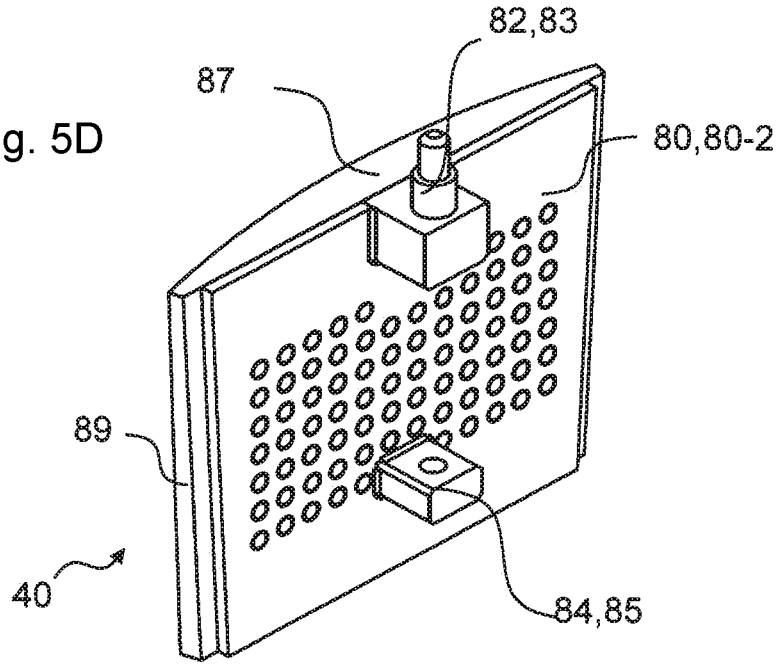
Figure 5E:
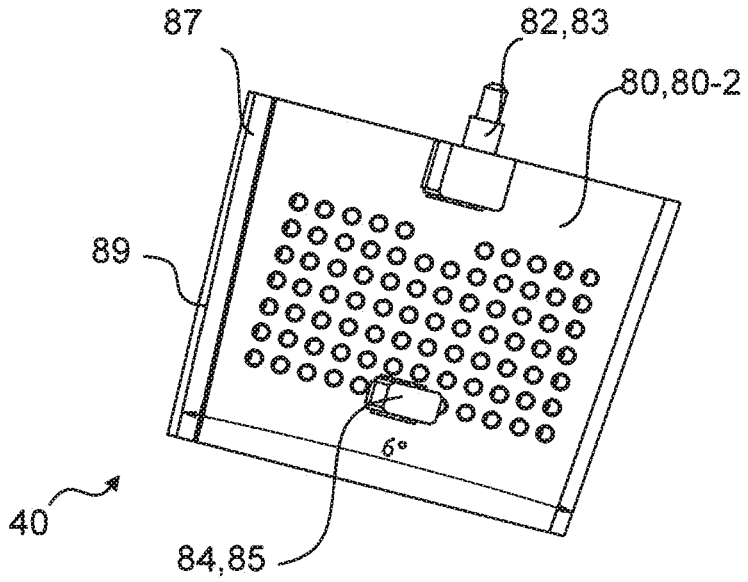

Sieve segments 30, 40 comprise on one side coating 87 with an elastic material, in particular with rubber or suchlike. Coating 87 is preferably constituted in the radial direction at least for the most part in the form of a radius. When FIGS. 4C, 5C are viewed, it becomes clear the coating 87 has maximum thickness $d_{max}$ in the region of axis of symmetry S between the two trapezoidal sides 33, whilst coating 87 has minimum thickness $d_{min}$ in the region of sides 33. This means that, proceeding from axis of symmetry 5, coating 87 thus tapers in cross-section on both sides.

Sieve plate 80 and coating 87 each comprise through-opening 81, 88. Through-openings 81, 88 are disposed such that in each case a first through-opening 81 of sieve plate 80 and a second through-opening 88 of coating 87 are aligned with one another and thus form a sieve opening 50.

Particularly in FIGS. 4A, 4D, 4D and 5A, 5C and 5D, it can clearly be seen that coating 87 projects laterally beyond sides 33 of sieve plate 80 and constitutes a conical coating side 89.

FIG. 6 show different views of assembled separating device 20 according to the invention fastened to a lid 90 for closing the grinding container.

The represented separating device comprises six first and six second sieve segments 30, 40, which are disposed alternately on frame 60, wherein trapezoidal sides 33, 43 each lie on transverse elements 62 of frame 60 and preferably abut against one another. This means that the width of transverse elements 62 is selected such that trapezoidal sides 33, 43 of a first or second sieve segment 30, 40 disposed between two transverse elements 62 for the most part lie completely on transverse elements 62. Spacing A between two adjacent transverse elements 62 (see FIG. 3A) of frame 60 broadly corresponds to the mean value of the lengths of base sides 31, 32 and 41, 42 of the trapezoidal areas. Preferably, A=½ X (length of short base side+length of long base side).

The commonly known outer cylindrical shape of ready-assembled separating device 20 is achieved by arranging in a row and fastening first and second sieve segments 30, 40 on frame 60 (see FIG. 3) with coating 87 facing outwards in each case.

In particular, sieve segments 30, 40 are fastened to frame 60 in that sieve segments 30, 40 are inserted, with their connecting means 82 or bolts 83, into fastening sockets 70 of first annular frame element 61-1 of frame 60. On the opposite side, a separate bolt 75 or another suitable connecting means is pushed through fastening device 72 of second annular frame element 61-2 of frame 60 into the locating means of sieve plate 80 of sieve segment 30, 40. In particular, second sieve segments 40 are first disposed on frame 60, wherein space for a first sieve segment 30 is left free in each case between individual second sieve segments 40. First sieve segments 30 are then inserted into the free spaces and fastened to the frame and, by means of separate bolt 75, to fastening devices 72 of second annular frame element 61-2 of frame 60.

On account of their respective trapezoidal shape, sieve segments 30, 40 are constituted conical in the axial direction of formed separating device cylinder 20. In particular, coating 87 projects uniformly beyond trapezoidal sides 33 of sieve plate 80, in order that sieve segments 30, 40 can be pressed against one another and a compression and therefore sealing results at the abutting edges or trapezoidal sides 33, 43 (see FIGS. 4 and 5).

First sieve segments 30 inserted last can be pushed manually between adjacent second sieve segments 40 until conical coating sides 89 (see FIGS. 4 and 5) or trapezoidal sides 33 lie adjacent to one another. The axial displacement then still required is achieved by closing with the aid of a lid 90 for closing the grinding stock cylinder, so that all sieve segments 30, 40 lie flush against one another in the axial direction. Lid 90 is screwed onto frame 60 and lies over separately inserted bolts 75. It thus prevents loosening of sieve segments 30, 40.

The invention has been described by reference to a preferred embodiment. A person skilled in the art can however imagine that modifications or changes to the invention can be made without thereby departing from the scope of protection of the following claims.

What is claimed is:

1. A ball mill or an agitator ball mill comprising: a separating device, wherein the ball mill or the agitator ball mill comprises a grinding stock inlet and a grinding stock outlet, wherein the separating device is configured to be disposed in and/or assigned to a region of the grinding stock outlet, wherein the separating device comprises a plurality of first and second sieve segments with sieve openings, which are disposed alternately on a frame, wherein a connecting means is assigned centrally to a short base side of the first sieve segments, and a locating means is assigned centrally in a region of or adjacent to a long base side of the first sieve segments, and wherein a locating means is assigned centrally in a region of or adjacent to a short base side of the second sieve segments, and a connecting means is assigned centrally to a long base side of the second sieve segments.

2. The ball mill or the agitator ball mill according to claim 1, wherein the arrangement of the first and second sieve segments on the frame constitutes a cylindrical shape of the separating device.

3. The ball mill or the agitator ball mill according to claim 2, wherein the first and second sieve segments each comprise a convexly curved outer lateral surface, wherein the first and second sieve segments are disposed on the frame in such a way that the outer surfaces of the totality of all the first and second sieve segments form a cylindrical shape with a circular base area.

4. The ball mill or the agitator ball mill according to claim 1, wherein the first and second sieve segments each comprise a convexly curved outer lateral surface, wherein the first and second sieve segments are disposed on the frame in such a way that the outer surfaces of the totality of all the first and second sieve segments form a cylindrical shape with a circular base area.

5. The ball mill or the agitator ball mill according to claim 1, wherein the first and second sieve segments each comprise trapezoidal areas.

6. The ball mill or the agitator ball mill according to claim 5, wherein the first and second sieve segments each comprise a coating.

7. The ball mill or the agitator ball mill according to claim 6, wherein the trapezoidal areas are constituted as sieve plates with first through-openings for the grinding stock and wherein the coating comprises second through-openings for the grinding stock, the second through-openings being disposed in alignment with the first through-openings of the trapezoidal areas.

8. The ball mill or the agitator ball mill according to claim 6, wherein the coating is deposited on the trapezoidal areas.

9. The ball mill or the agitator ball mill according to claim 8, wherein the trapezoidal areas are isosceles trapezoidal areas, wherein the coating has a maximum thickness ($d_{max}$) in a region of an axis of symmetry (S) of the isosceles trapezoidal areas and a minimum thickness ($d_{min}$) in a region of the sides of the isosceles trapezoidal area.

10. The ball mill or the agitator ball mill according to claim 9, wherein the coating forms a convex outwardly curved outer lateral surface with the maximum thickness ($d_{max}$) in the region of the axis of symmetry (S) of the isosceles trapezoidal area.

11. The ball mill or the agitator ball mill according to claim 1, wherein the frame comprises two annular elements, which are connected to one another by transverse elements.

12. The ball mill or the agitator ball mill according to claim 11, wherein the first and second sieve segments comprise trapezoidal areas with identical areas and wherein a spacing (A) between the transverse elements of the frame corresponds to a mean value of lengths of base sides of the trapezoidal areas.

13. The separating device according to claim 1, wherein the frame comprises a first annular element and a second annular element which are connected to one another by transverse elements, wherein fastening sockets for the connecting means of the first and second sieve segments are assigned to the first annular element of the frame and wherein openings for fastening the first and second sieve segments are assigned to the second annular element of the frame.

14. The ball mill or the agitator ball mill according to claim 13, wherein the first and second sieve segments are configured to be fastened to the second annular element via fasteners engaging through the openings into each of the locating means of the first and second sieve segments.

* * * * *